United States Patent [19]

Rawicz-Szcerbo

[11] Patent Number: 4,579,217

[45] Date of Patent: Apr. 1, 1986

[54] ELECTRONIC COIN VALIDATOR

[75] Inventor: Adam Rawicz-Szcerbo, Oldham, England

[73] Assignee: Coin Controls Limited, Royton, England

[21] Appl. No.: 614,829

[22] Filed: May 29, 1984

[30] Foreign Application Priority Data

Jun. 6, 1983 [GB] United Kingdom ..... 8315449

[51] Int. Cl.[4] ..... G07F 3/02

[52] U.S. Cl. ..... 194/317

[58] Field of Search ..... 194/100 A, 100 R; 133/3 R; 201/571; 73/163

[56] References Cited

U.S. PATENT DOCUMENTS 4,234,071 11/1980 Le-Hong ..... 194/100 A

*Primary Examiner*—Stanley H. Tollberg

*Attorney, Agent, or Firm*—Wolf, Greenfield & Sacks

[57] ABSTRACT

An electronic coin validator comprising an inductive coin sensor (10) producing a predetermined response to a valid coin and a coin equivalent circuit (18, 20) which can be switched by a switch (14, 16) into operable connection with the sensor to produce an effect on the coin sensor similar to that of a coin but with the coin absent, and a comparator (26) for comparing the two sensor responses. The arrangement has the advantage of ensuring stability against temperature drift, small mechanical changes, aging and the like, because these disturbances have the same effect on both of the signals which are compared for coin validation purposes.

10 Claims, 2 Drawing Figures

ELECTRONIC COIN VALIDATOR

This invention relates to an electronic coin validator and more especially to such a validator employing an inductive sensor.

The inductive sensor of such a coin validator usually forms part of an oscillator the output of which is varied due to coin passage. The sensor may have a single inductive coil or may have transmit and receive coils, and the measured response to coin passage may be amplitude change, frequency change or phase change. Commonly it is required to test a coin for metal content and for diameter, and inductive sensors of differing types may be employed for the two purposes, and differing types of response may be measured for said two purposes.

In general, all sensors of this type give rise to the problem that, due to temperature drift, small mechanical changes occurring in use, aging of components and the like, the response of the sensor to coin passage can change, producing an inconsistent measured output, over a period of time. This period is usually quite long, but can be quite short in some circumstances.

As a result of drift and disturbance factors, comparison between the coin response signal and a fixed reference threshold can prove unreliable, leading to rejection of true coins and acceptance of bad coins.

Hitherto, proposals to overcome this problem have been based on the concept of measuring a standby output of the oscillator/sensor when no coin is present, this being either a long term output which is integrated or an instantaneous output immediately prior to coin sensing. The standby output can be used to correct either the coin response signal or the reference threshold.

An object of this invention is to provide an alternative and improved electronic coin validator wherein stability against drift and other disturbances is ensured in a different manner.

According to the invention, an electronic coin validator has an inductive coin sensor responding in a predetermined manner to passage of a coin, a circuit switchable into operative connection with the coin sensor to produce a response generally similar to that of a coin but when no coin is present, and means for comparing the response of the sensor to coin passage with the response to connection of said circuit in order to test the coin for validity.

The said circuit is preferably switched into operable connection with the sensor in close time relationship to coin sensing, for example immediately afterwards, and means directly or indirectly responsive to coin passage may be provided to effect such switching automatically.

The tested responses may be of amplitude change, e.g. using an oscillator/sensor of which the oscillations are correspondingly quenched by coin passage and by a switched in impedance, but can alternatively be frequency change or phase change.

When two inductive sensors, possibly of differing types leading to two differing kinds of tested response, are provided, an appropriate switchable circuit will be employed for each sensor.

In a practical arrangement, a plurality of said circuits are provided, respectively having differing effects on the sensor corresponding to the differing effects thereon of coins of differing denominations. Said circuits may be successively switched into operable connection with the sensor and the response of the oscillator to coin passage is compared with the successive oscillator responses to the successive switching of said circuits.

Means can be provided for storing a signal representing the oscillator response to coin passage ready for comparison with the subsequent response of the oscillator to switching of said circuit.

Some examples of electronic coin validator are now described with reference to the accompanying drawings, wherein.

Figure 1:
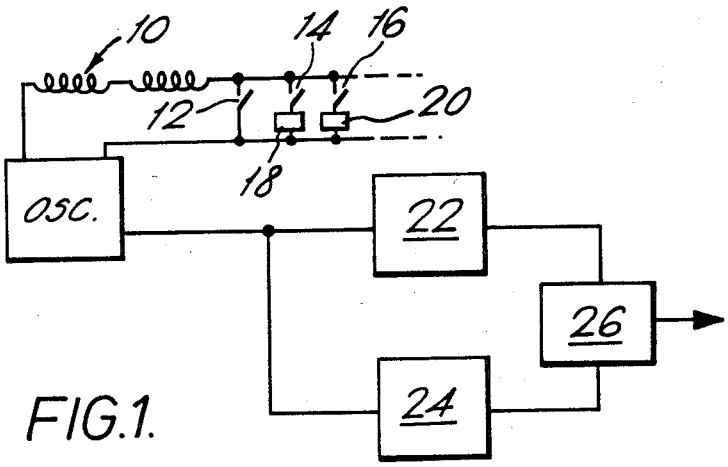
FIG. 1 is a block circuit diagram for a first arrangement.

In FIG. 1, the reference 10 denotes an oscillator/inductive sensor of one of the kinds basically well known in the art.

Connectable to the oscillator circuit by means of switches 12, 14, 16 etc. are a sequence of resistances 18, 20 etc. The switches 12, 14, 16 etc. are closable in sequence.

For example, a coin entry detector may close the switch 12 to render the oscillator operative in a normal manner to respond to coin passage. Switches 14, 16 may then be operative in sequence automatically due to activation of a detector located just downstream of the coin sensor 10.

The normal coin response signal, for example the change of amplitude of oscillations, is stored in a memory circuit 22, such as a sample and hold circuit.

The response signals due to successive closure of switches 14, 16 etc., which in turn connect one of the resistors 18, 20 in series with the oscillator coil to effect a change of amplitude of the oscillations, are fed to a signal processor 24 which prepares these signals for comparison with the stored coin response signal at a comparator 26.

The values of the resistors 18, 20 etc. are respectively chosen to have the same effect on the oscillator response as true coins of respective denominations. Thus, at the comparator, which in practice will be a window comparator with upper and lower thresholds, unless a coin response signal generally corresponds to the response due to one of the switched in resistors, the coin will be rejected.

The above-described validator has the advantage of achieving stability against drift and other disturbances because, at least to a very close approximation within the window of the comparator, the effect of such drift or the like on the coin response signal will be the same as that on the signals responsive to the switched in resistances, which are obtained in very close time proximity to said coin response signal.

Not only in the case of comparing changes in amplitude, but also in the case of measuring frequency response or phase response, electrical components in the switched in circuits can be arranged to have a generally similar response to that of a true coin, with sufficient accuracy reliably to ensure acceptance of true coins and rejection of bad coins, even when temperature drift or other disturbances have occurred.

Furthermore, assuming that two oscillator/sensors are provided, respectively for testing coin material and coin diameter, circuits which can be switched in to counteract drift effects or the like can be provided in association with each such oscillator/sensor, thereby to ensure accuracy of testing in respect of both coin material and coin diameter.

Figure 2:
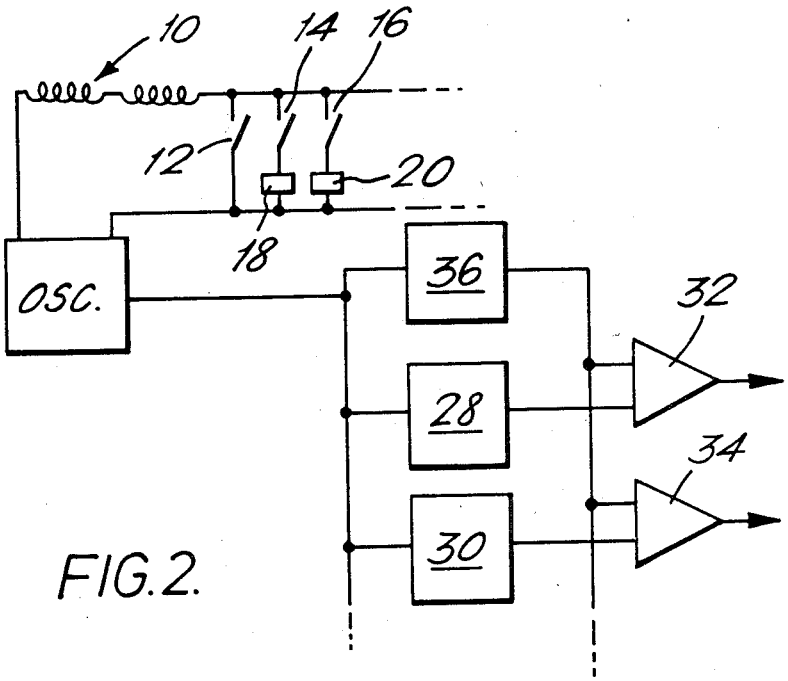
FIG. 2 is a block circuit diagram for a second arrangement.

FIG. 2 shows an alternative arrangement which will be clear without detailed description. In this arrangement, the switches 14, 16 etc. are successively switched in sequence, repetitively, whilst no coin is present. These signals are stored in a corresponding number of sample and hold circuits 28, 30 etc., which memory circuits are continuously updated. On detection of coin entry, switch 12 is closed, and this coin response signal (through 36) is compared with each of the currently stored signals at respective comparators 32, 34 etc. One and only one such comparator is required to produce an accept signal to enable a coin to be accepted.

The arrangement shown in FIG. 2 has the advantage, over the arrangement of FIG. 1, of achieving a reduced decision time measured from coin insertion.

In a modification (not illustrated) of the arrangement shown in FIG. 2, the coin-equivalent resistance signals are converted from analogue to digital values which are then stored in a digital memory.

When a coin is inserted, all resistors 18, 20 etc. are disconnected, and the coin response signal is stored in a sample and hold circuit. This signal is then converted from an analogue value to a digital value and compared with the values stored in the memory. The nearest coin equivalent resistor is then selected, immediately after the coin has passed the coin sensor, so that the resulting analogue signal is very accurately compared with the coin response value stored in the sample and hold circuit.

The described technique reduces the required number of sample and hold circuits (assuming coins of various denominations are to be tested), whilst also giving a reduced decision time. The particular technique described also avoids the requirement for expensive, high resolution A/D converters, since the final, accurate coin test is performed with analogue values.

It is to be appreciated that the above-described arrangements are by way of example only and may be modified in various ways within the scope of the invention defined in the appended claims.

I claim:

1. An electronic coin validator with drift compensation, comprising:

an inductive coin sensor circuit having operating parameters that tend to drift and including an inductance for inductive coupling to a coin to produce a coin indicative signal, said signal being subject to drift in dependence upon drift of said operating parameters, reference circuit means switchable into operative connection with said coin sensor circuit to produce a coin reference signal commensurately subject to drift in dependence upon said drift sensitive circuit operating parameters, and comparing circuit means for comparing said coin indicative signal with said coin reference signal to provide an output signal representative of the coin and for which the effects of said drift sensitive operating parameters are at least reduced.

2. An electronic coin validator according to claim 1, wherein the said circuit is switched into operable connection with the sensor in close time relationship to coin sensing.

3. An electronic coin validator according to claim 2, wherein the said circuit is switched into operable connection with the sensor immediately after completion of coin sensing.

4. An electronic coin validator according to claim 1, wherein the inductive coin sensor provides an output which is amplitude dependent on coin passage, and the said circuit includes a component which also affects the amplitude of the sensor output.

5. An electronic coin validator having an inductive coin sensor responding in a predetermined manner to passage of a coin, a circuit switchable into operative connection with the coin sensor to produce a response generally similar to that of a coin but when no coin is present, and means for comparing the response of the sensor to coin passage with the response to connection of said circuit in order to test the coin for validity, wherein the inductive coin sensor comprises a tuned oscillator circuit of which the oscillations are damped or quenched by passage of a coin and by connection of said circuit.

6. An electronic coin validator according to claim 5, wherein the said circuit comprises an impedance for damping or quenching the said oscillations.

7. An electronic coin validator according to claim 1, wherein a plurality of said circuits are provided, respectively having differing effects on the sensor corresponding to the differing effects thereon of coins of differing denominations.

8. An electronic coin validator according to claim 7, wherein said inductive coin sensor comprises an oscillator and said circuits are successively switched into operable connection with the sensor and the response of the oscillator to coin passage is compared with the successive oscillator response to the successive switching of said circuits.

9. An electronic coin validator according to claim 1, wherein said inductive coin sensor comprises an oscillator and including means for storing a signal representing the oscillator response to coin passage ready for comparison with the subsequent response of the oscillator to switching of said circuit.

10. An electronic coin validator according to claim 1, including means directly or indirectly responsive to coin passage for automatically switching said circuit into connection with the sensor immediately after coin sensing has been completed.

* * * * *